US009105422B2

(12) United States Patent
Liu et al.

(10) Patent No.: US 9,105,422 B2
(45) Date of Patent: Aug. 11, 2015

(54) THIN KEY STRUCTURE

(71) Applicant: ICHIA TECHNOLOGIES,INC., Taoyuan County (TW)

(72) Inventors: Chang-Li Liu, Taoyuan County (TW); Yu-Chih Chang, Taoyuan County (TW)

(73) Assignee: ICHIA TECHNOLOGIES, INC., Taoyuan County (TW)

( * ) Notice: Subject to any disclaimer, the term of this patent is extended or adjusted under 35 U.S.C. 154(b) by 286 days.

(21) Appl. No.: 13/894,967

(22) Filed: May 15, 2013

(65) Prior Publication Data

US 2014/0224634 A1 Aug. 14, 2014

(30) Foreign Application Priority Data

Feb. 8, 2013 (TW) ..... 102203092 U

(51) Int. Cl.
*H01H 13/702* (2006.01)
*H01H 13/705* (2006.01)
*H01H 13/7073* (2006.01)

(52) U.S. Cl.
CPC ..... *H01H 13/7073* (2013.01); *H01H 2205/024* (2013.01); *H01H 2215/006* (2013.01); *H01H 2221/016* (2013.01); *H01H 2227/036* (2013.01)

(58) Field of Classification Search
CPC . H01H 13/70; H01H 13/7073; H01H 13/702; H01H 13/705; H01H 13/14
USPC ..... 200/512–520, 310–317, 600
See application file for complete search history.

(56) References Cited

U.S. PATENT DOCUMENTS

| | | | | |
|---|---|---|---|---|
| 7,663,071 | B2 * | 2/2010 | Chang | 200/345 |
| 7,777,144 | B2 * | 8/2010 | Wu et al. | 200/313 |
| 2007/0007112 | A1 * | 1/2007 | Hashida | 200/5 A |
| 2008/0128254 | A1 * | 6/2008 | Jung et al. | 200/512 |

* cited by examiner

*Primary Examiner* — Amy Cohen Johnson
*Assistant Examiner* — Marina Fishman
(74) *Attorney, Agent, or Firm* — Li & Cai Intellectual Property (USA) Office

(57) ABSTRACT

A thin key structure includes a supporting module, a circuit module disposed on the supporting module, a frame and a metal dome disposed on the circuit module, a pressable module, and a guiding portion. The supporting module has a supporting plate and a protrusion disposed on the supporting plate. The supporting plate has a plane defined therein, the plane defines a perpendicular central axis, and the protrusion is arranged on the central axis. The circuit module has a protruding segment formed by the protrusion. The metal dome is arranged in the frame, and has a contact portion arranged on the central axis. The guiding portion arranged on the central axis and is disposed between the contact portion and the pressable module. The metal dome is pressed by the guiding portion to move the contact portion along the central axis and selectively abuts the circuit module.

10 Claims, 21 Drawing Sheets

THIN KEY STRUCTURE

BACKGROUND OF THE INVENTION

1. Field of the Invention

The instant disclosure relates to a key structure; more particular, to a thin key structure.

2. Description of Related Art

The key structure is a common input device, which is widely used in different electronic devices, such as the mobile phones, the handheld computers, and the remote controllers. Currently, with the miniaturization of the various electronic devices, the thickness of the key structure is designed toward thinner and thinner. However, the conventional key structure still has some problems, which need to be overcome.

For example, the conventional key structure mainly has a key, an elastic layer, and a circuit board. The elastic layer is disposed under the key, and is disposed on the circuit board, and the elastic layer has an elastic sheet arranged correspondingly to the key. Thus, when the key is pressed down, the center portion of the elastic sheet is elastically concaved, so that the concaved center portion of the elastic sheet elastically deforms to abut the electrodes of the circuit board, thereby providing electrical connection between the elastic layer and the circuit board. Thus, a signal transmission is transmitted each time a key is pressed.

However, because the pressed portion of the key is different each time the key is pressed, the deformation of each stroke of the key is different. As a result, the key may not make contact with the elastic sheet at the same contact point. Specifically, if the pressed portion of the elastic sheet with respect to the key offsets from the center of the elastic sheet, the deformation of the elastic sheet can easily misalignment to influence the electrical connection between the elastic sheet and the circuit board.

To achieve the abovementioned improvement, the inventors strive via industrial experience and academic research to present the instant disclosure, which can provide additional improvement as mentioned above.

SUMMARY OF THE INVENTION

One embodiment of the instant disclosure provides a thin key structure capable of preventing misalignment of the metal dome when deformed, so as to maintain the electrical connection between the metal dome and the circuit module.

The thin key structure comprises a supporting module, a circuit module, a frame, a metal dome, a pressable module, and a guiding portion. The supporting module has a supporting plate and a protrusion, in which the supporting plate has a plane defined therein and a central axis perpendicular to the plane, and the protrusion is arranged on the central axis. The circuit module is disposed on the supporting plate and abuts the protrusion, in which the circuit module has a protruding segment formed thereon and abuts the protrusion. The frame is disposed on the circuit module, in which the frame defines an accommodating space. The metal dome is disposed on the circuit module and arranged in the accommodating space, in which an inner portion of the metal dome is approximately arranged at the central axis and is defined with a contact portion. The pressable module disposed on the frame, in which at least portion of the pressable module is configured above the metal dome. The guiding portion is configured to align with the central axis and between the contact portion of the metal dome and the pressable module. The guiding portion is formed on the metal dome or the pressable module, in which the pressable module is configured to be pressed for deforming the metal dome by the guiding portion to displace the contact portion from an original position to a conductive position along the central axis. When the contact portion is at the original position, the contact portion and the circuit module are configured with a gap therebetween and when the contact portion is at the conductive position, the contact portion presses the circuit module.

Base on the above, the thin key structure of the instant disclosure keeps the contact position of the metal dome when the pressable module is pressed through the arrangement of the guiding portion. As a result, the contact portion of the metal dome can maintain displacement along the central axis. Moreover, the protrusion is arranged not only to steadily maintain the contact position of the contact portion with respect to the circuit module, but also to reduce the required operating distance of the metal dome.

DETAILED DESCRIPTION OF THE PREFERRED EMBODIMENTS

In order to further appreciate the characteristics and technical contents of the instant disclosure, references are hereunder made to the detailed descriptions and appended drawings in connection with the instant disclosure. However, the appended drawings are merely shown for exemplary purposes, rather than being used to restrict the scope of the instant disclosure.

First Embodiment

Figure 1:
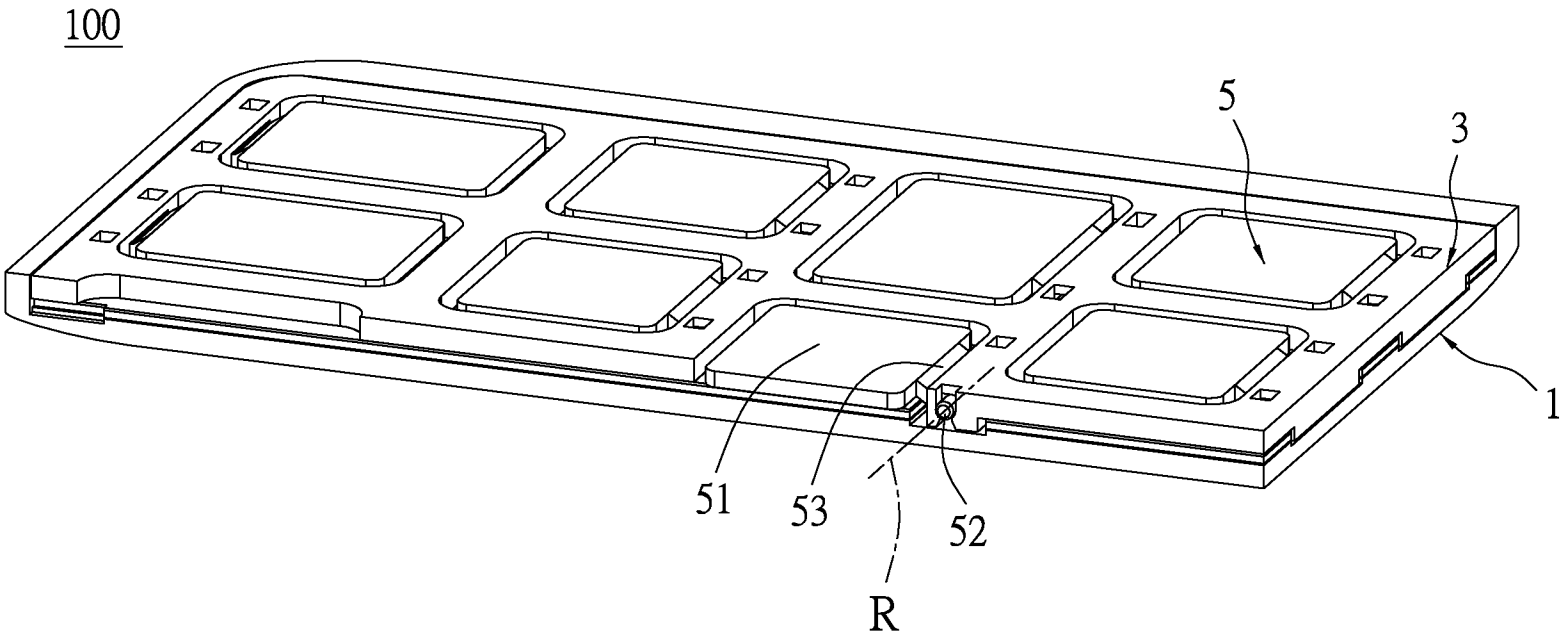
FIG. 1 is a perspective view showing a first embodiment according to the instant disclosure.
Figure 2:
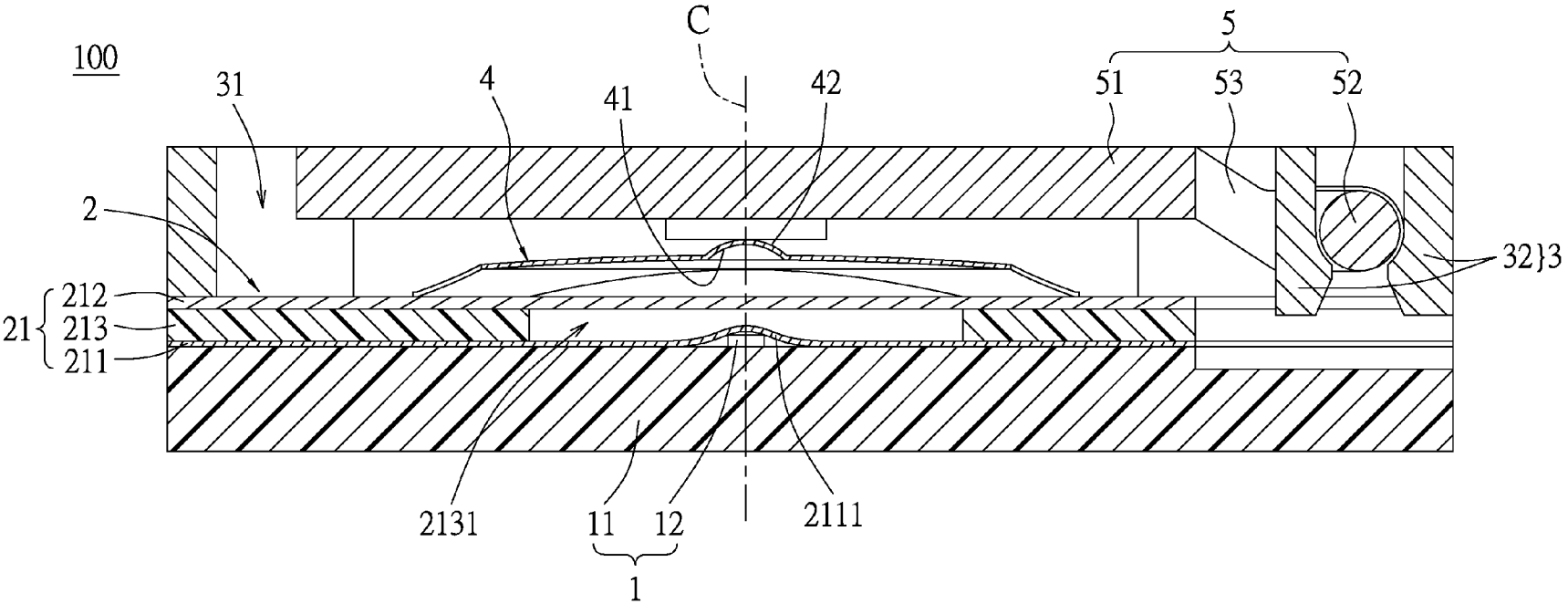
FIG. 2 is a cross-sectional view showing the first embodiment at an original position according to the instant disclosure.
Figure 3:
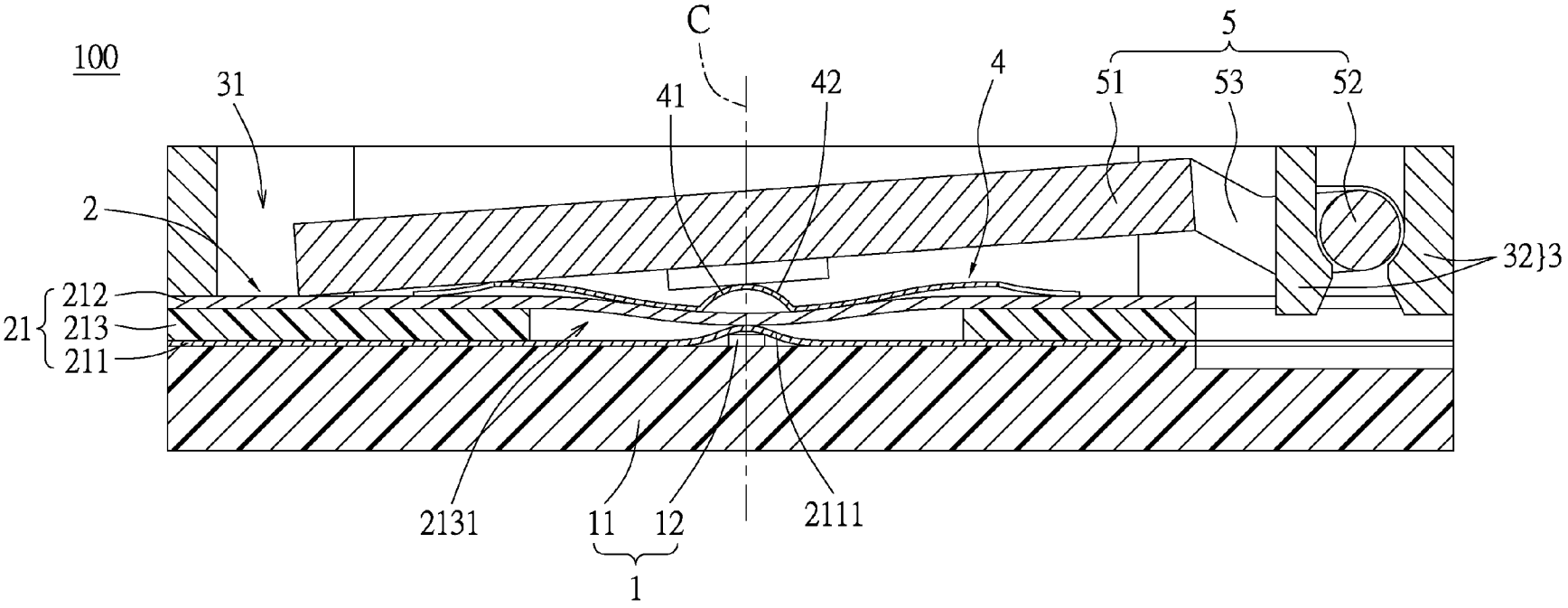
FIG. 3 is a cross-sectional view showing the first embodiment at a conductive position according to the instant disclosure.

Please refer to FIGS. 1 through 3, which show a first embodiment of the instant disclosure. The instant embodiment provides a thin key structure 100 having a supporting module 1, a circuit module 2, a frame 3, a metal dome 4, and a pressable module 5. The thickness of the thin structure 100 in the instant embodiment is preferable less than 3.4 mm. The following description states each element firstly, and then states the relationship between the elements at an appropriate time.

The supporting module 1 has supporting plate 11 resembling a plane and a protrusion 12 disposed on the supporting plate 11. The supporting plate 11 has a plane defined therein. The plane defines a central axis C perpendicular thereto, and the protrusion 12 is arranged on the central axis C.

The instant embodiment takes the protrusion 12 installed on the supporting plate 11 as an example, that is to say, the protrusion 12 is an independent element (e.g., block). The protrusion 12 can be formed by directly punch pressing the supporting plate 11, in other words, the supporting plate 11 and the protrusion 12 can be integrally formed.

The circuit module 2 is disposed on the supporting plate 11 and abuts the protrusion 12. The circuit module 2 has a protruding segment 2111 formed by being pressed with the protrusion 12. Specifically, the circuit module 2 has a membrane 21 having a first conductive layer 211, a second conductive layer 212, and a separating layer 213 disposed between the first and the second conductive layers 211, 212. The separating layer 213 defines an accommodating hole 2131. Moreover, the first conductive layer 211 is disposed on the supporting plate 11, and a segment of the first conductive layer 211 abuts the protrusion 12 to define the protruding segment 2111. The protruding segment 2111 is arranged in the accommodating hole 2131. Thus, the shortest distance between the first and the second conductive layers 211, 212 is reduced effectively to improve the sensitivity of the membrane 21 via the configuration of the protrusion 12 to form the protruding segment 2111 of the first conductive layer 211.

In more detail, the separating layer 213 supports and separates the first and the second conductive layers 211, 212, and a deformable portion of the second conductive layer 212 corresponding to the protruding segment 2111 is elastically deformable. The protruding segment 2111 of the first conductive layer 211 and the deformable portion of the second conductive layer 212 each has an electrode of opposing charge (e.g., positive electrode and negative electrode) and are configured with a gap therebetween. When the deformable portion of the second conductive layer 212 is deformed and abuts the protruding segment 2111 of the first conductive layer 211, the electrodes of the first and the second conductive layers 211, 212 abut each other to achieve electrical connection.

Figure 4:
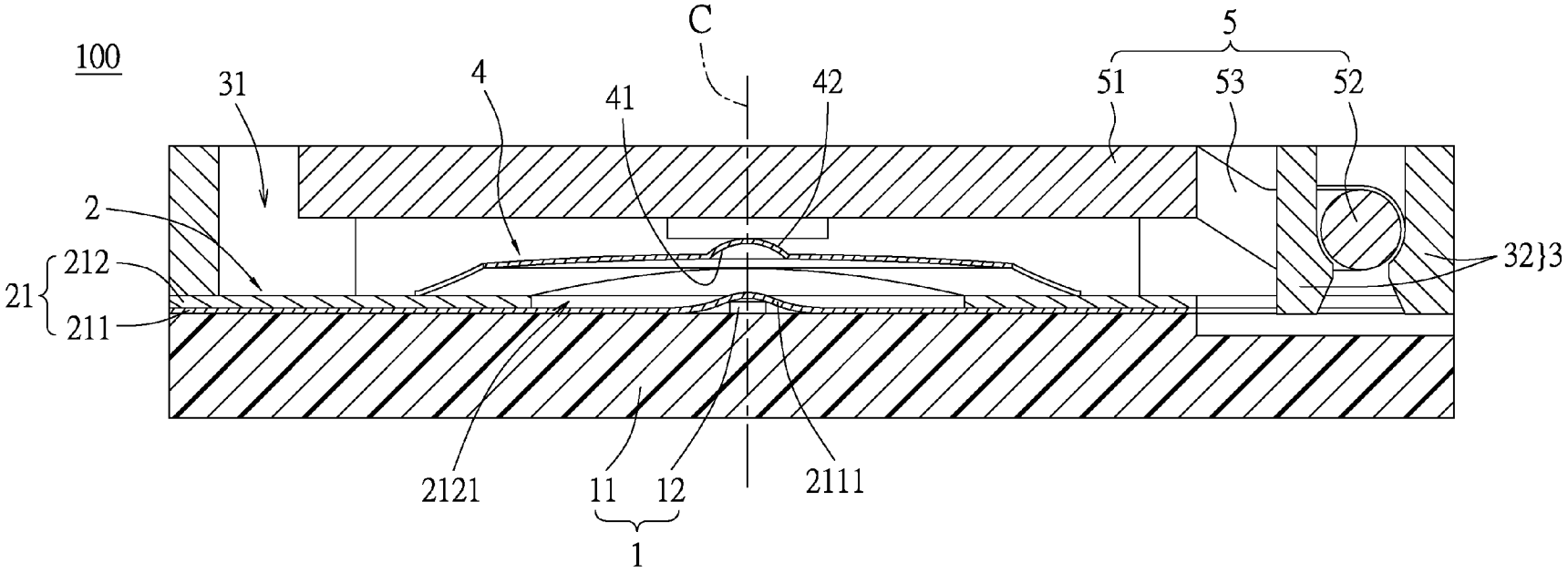
FIG. 4 is a cross-sectional view showing the first embodiment, which has the membrane with dual layer, at the original position according to the instant disclosure.
Figure 5:
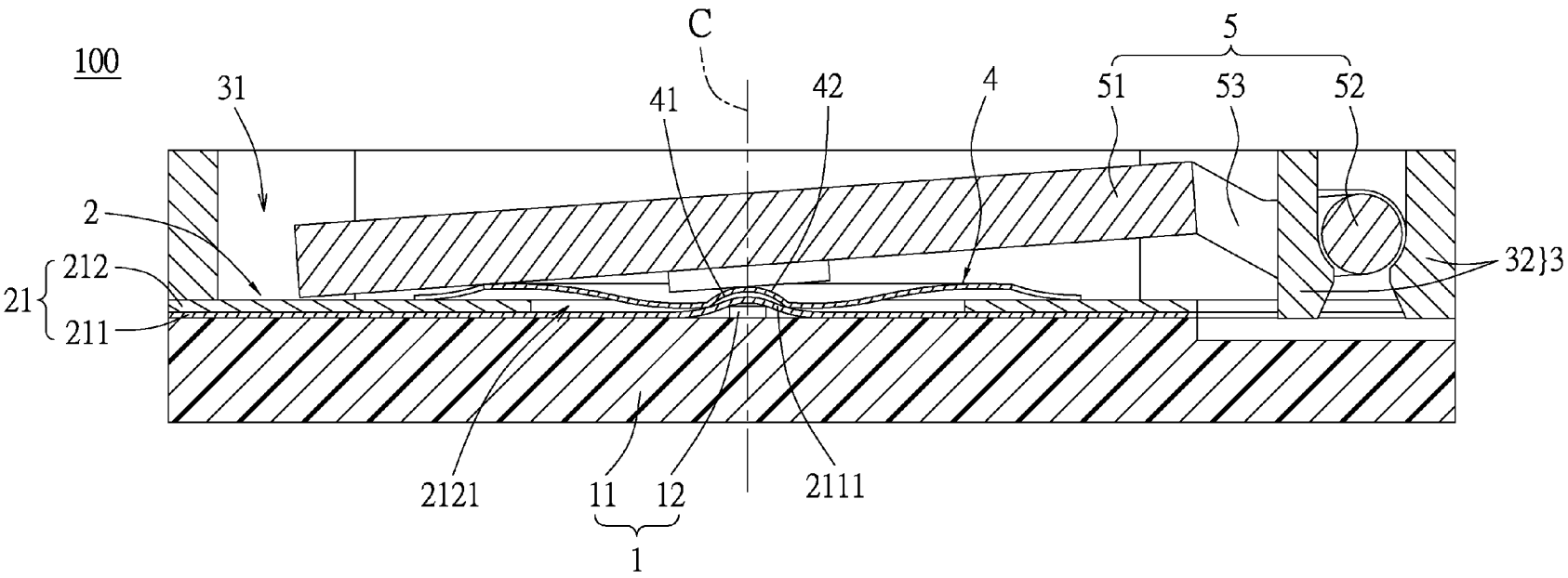
FIG. 5 is a cross-sectional view showing the first embodiment, which has the membrane with dual layer, at the conductive position according to the instant disclosure.

Moreover, the membrane 21 can be a dual layer structure as shown in FIGS. 4 and 5. The membrane 21 has a first conductive layer 211 and a second conductive layer 212 disposed on the first conductive layer 211. The second conductive 212 defines an accommodating opening 2121. The first conductive layer 211 is disposed on the supporting plate 11, and a segment of the first conductive layer 211 abutting the protrusion 12 is defined as the protruding segment 2111 which is configured in the accommodating opening 2121. The protruding segment 2111 is exposed to the environment via the accommodating opening 2121 of the second conductive layer 212.

Specifically, the first conductive layer 211 is initially electrically insulated from the second conductive layer 212. An outer surface of protruding segment 2111 and an outer surface of the second conductive layer 212 each has an electrode of opposing charge (e.g., positive electrode and negative electrode). When a conductive piece (e.g., metal dome 4) is disposed on the electrode of the second conductive layer 212 and the conductive piece deforms and abuts the electrode of the first conductive layer 211, the first and the second conductive layers 211, 212 are in electrical connection by the conductive piece.

Moreover, the circuit module 2 in the instant embodiment takes the membrane 21 for example, the membrane 21 can be replaced by a flexible printed circuit (FPC), a flexible flat cable (FFC), or the other elements having the same function.

Please refer to FIGS. 1 through 3. The frame 3 is disposed on the circuit module 2. The frame 3 is defined with an accommodating space 31, and the frame 3 has a pivoting portion 32 formed on an inner lateral wall thereof. The pivoting portion 32 in the instant embodiment uses a plurality of resilient hooks for example, but the pivoting portion 32 is not limited to the instant embodiment.

The metal dome 4 is disposed on the second conductive layer 212 of the circuit module 2 and arranged in the accommodating space 31 of the frame 3. An inner portion of the metal dome 4 approximately arranging on the central axis C is defined as a contact portion 41, and a guiding portion 42 (e.g., plunger) is oppositely arranged on the metal dome 4 with respect to the contact portion 41. That is to say, the guiding portion 42 is also arranged on the central axis C. Moreover, the metal dome 4 in the instant embodiment is integrally formed and is symmetric to the central axis C. A projecting portion of the metal dome 4 is formed by punch pressing an inner portion of the metal dome 4, and the thickness of the projecting portion is uniform and identical. The outer surface of the projecting portion is defined as the guiding portion 42, and the inner surface of the projecting portion is defined as the contact portion 41.

The pressable module 5 has a key body 51, an assembling portion 52, and a connecting portion 53 connecting to the key body 51 and the assembling portion 52. The connecting portion 53 and the assembling portion 52 are integrally extended from a side edge of the key body 51 in sequence. The assembling portion 52 has an elongated shape and a longitudinal axis of the assembling portion 52 defined as a pivot axis R. The assembling portion 52 is rotatively coupled to the pivoting portion 32 of the frame 3, that is to say, the pivoting portion 32 clips the assembling portion 52, so that the longitudinal axis of the assembling portion 52 is substantially perpendicular to the central axis C. The key body 51 is configured to be pressed to rotate along the pivot axis R. The key body 51 is arranged above the contact portion 41 of the metal dome 4 and abuts the guiding portion 42, in other words, the guiding portion 42 is arranged between the contact portion 41 and the key body 51.

The above description states the structural features of the thin key structure 100, and the following description states the operation of the thin key structure 100.

The key body 51 of the pressable module 5 is configured to be pressed for rotating the key body 51 along the pivot axis R, so that the metal dome 4 is resiliently deformed by the guiding portion 42, and the contact portion 41 is displaced from an original position (as FIG. 2 shown) to a conductive position (as FIG. 3 shown) along the central axis C. Moreover, when the contact portion 41 is at the original position, the contact portion 41 and the circuit module 2 are configured with a gap therebetween; when the contact portion 41 is at the conductive position, the periphery edge of the contact portion 41 presses against the circuit module 2.

Specifically, if the membrane 21 is a three layer construction as shown in FIGS. 2 and 3 and when the contact portion 41 is at the original position, the protruding segment 2111 of the first conductive layer 211 and the deformable portion of the second conductive layer 212 corresponding to the protruding segment 2111 are configured with a gap therebetween. When the contact portion 41 is at the conductive position, the deformable portion of the second conductive layer 212 is pressed by the periphery edge of the contact portion 41 to deform and abut the protruding segment 2111 of the first conductive layer 211, so that the first and the second conductive layers 211, 212 are in electrical connection.

Additionally, if the membrane 21 is the dual layer construction as shown in FIGS. 4 and 5 and when the contact portion 41 is at the original position, the protruding segment 2111 of the first conductive layer 211 and the contact portion 41 are configured with a gap therebetween via the accommodating opening 2121. When the contact portion 41 is at the conductive position, the periphery edge of the contact portion 41 contacts the protruding segment 2111 of the first conductive layer 211, so that the first and the second conductive layers 211, 212 are in electrical connection via the metal dome 4.

Figure 6:
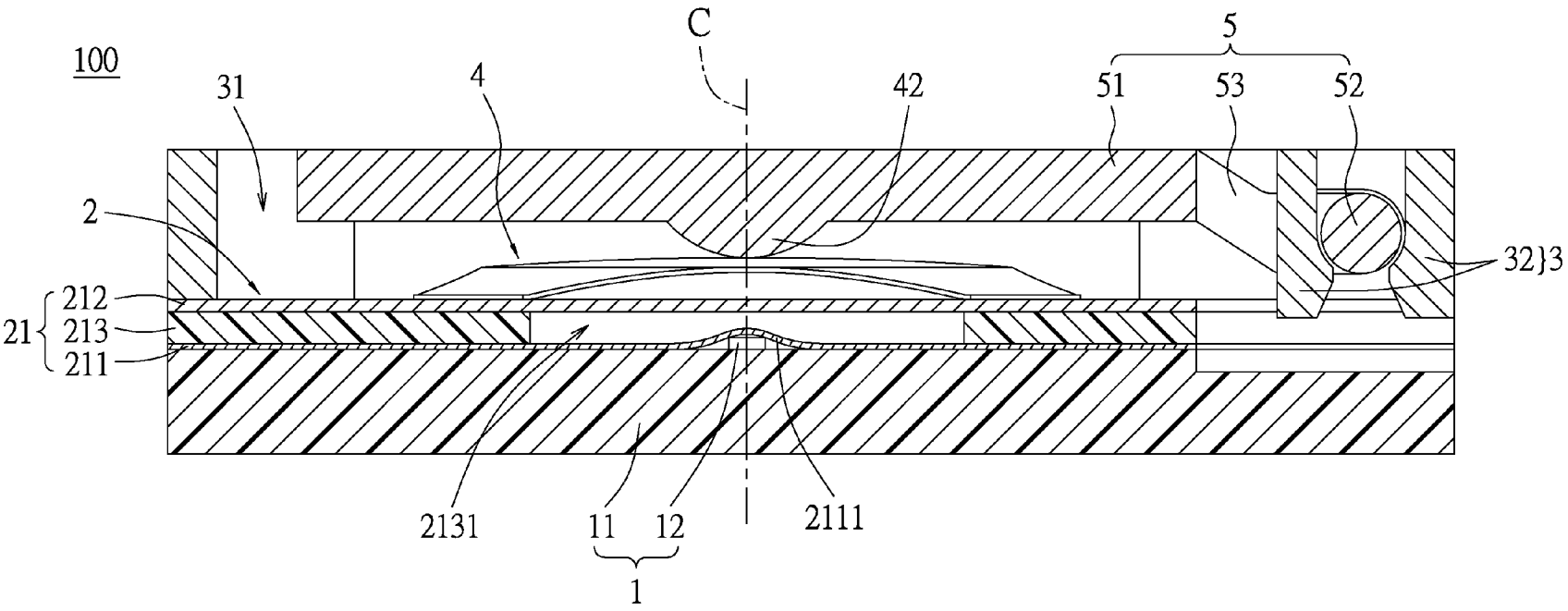
FIG. 6 is a cross-sectional view showing another state of the first embodiment according to the instant disclosure.

Moreover, the guiding portion 42 can be arranged on the key body 51 as shown in FIG. 6. Specifically, the guiding portion 42 is integrally formed on a bottom surface of the key body 51 adjacent to the metal dome 4, so that the key body 51 is configured to be pressed for deforming the metal dome 4 via the guiding portion 42.

Second Embodiment

Figure 7:
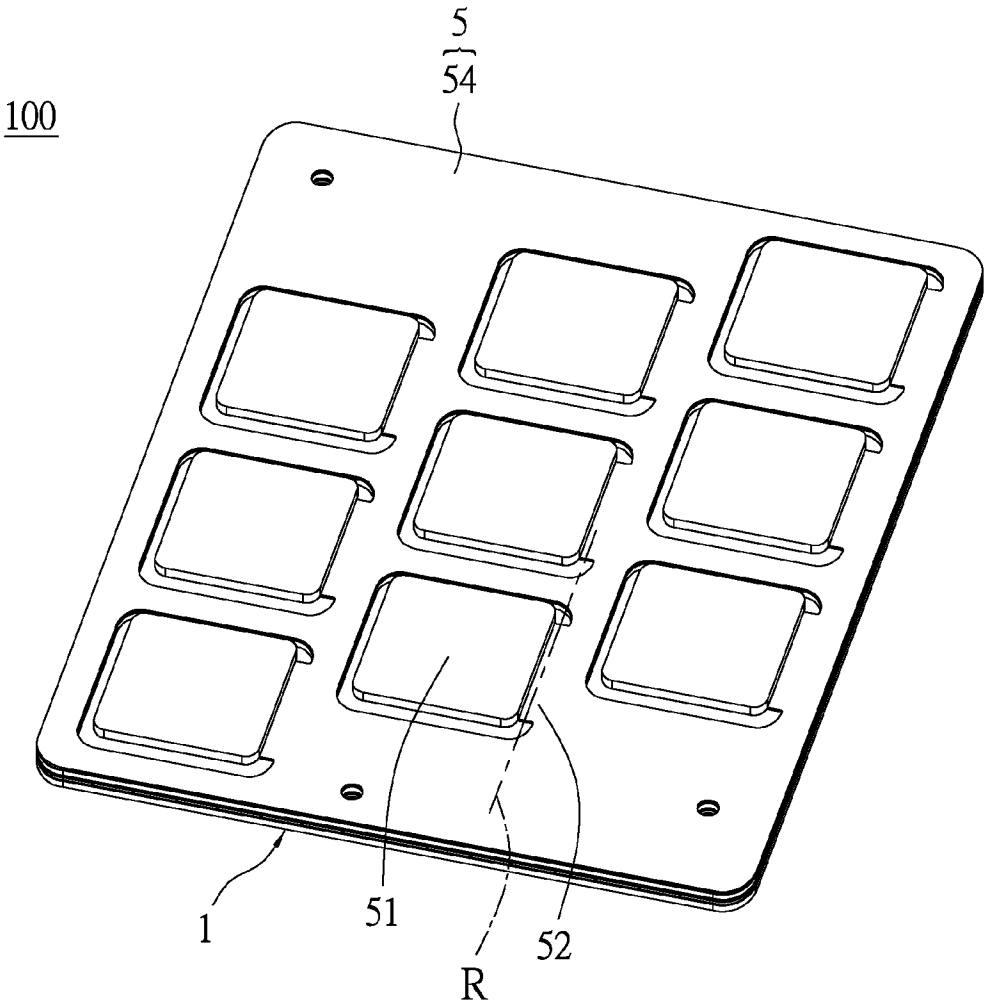
FIG. 7 is a perspective view showing a second embodiment according to the instant disclosure.
Figure 8:
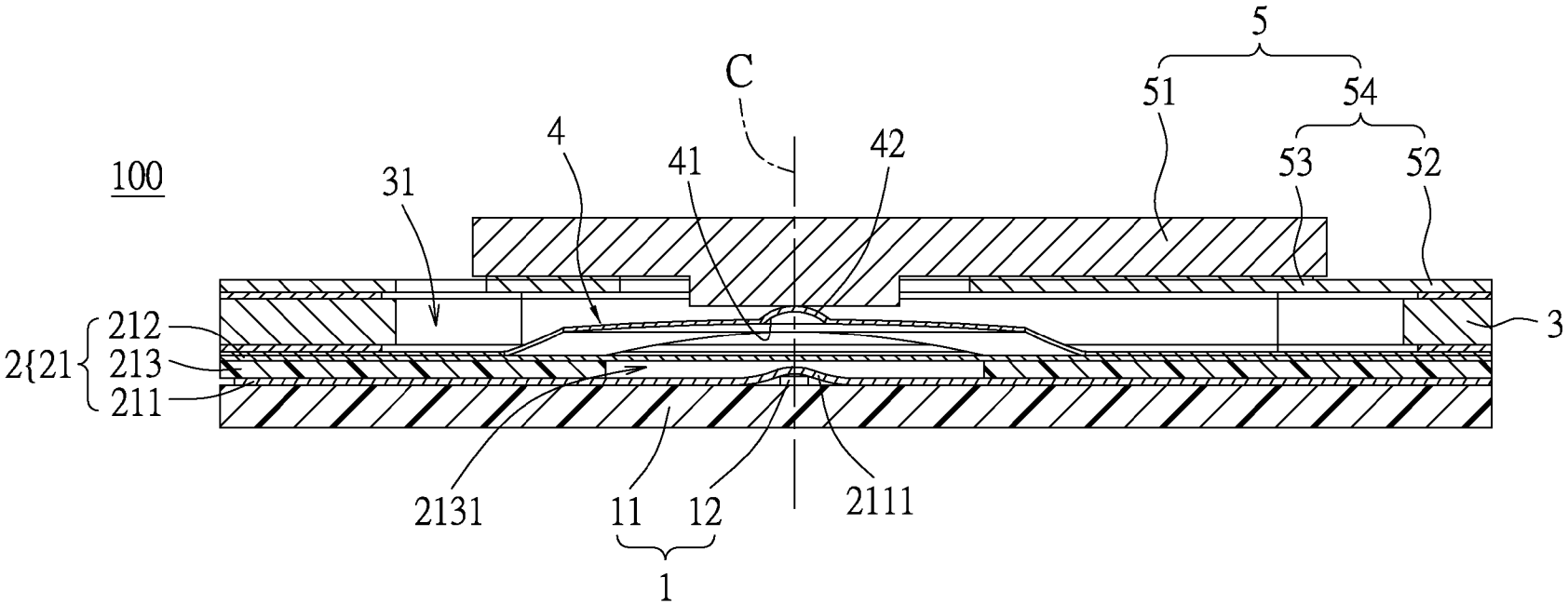
FIG. 8 is a cross-sectional view showing the second embodiment at an original position according to the instant disclosure.
Figure 9:
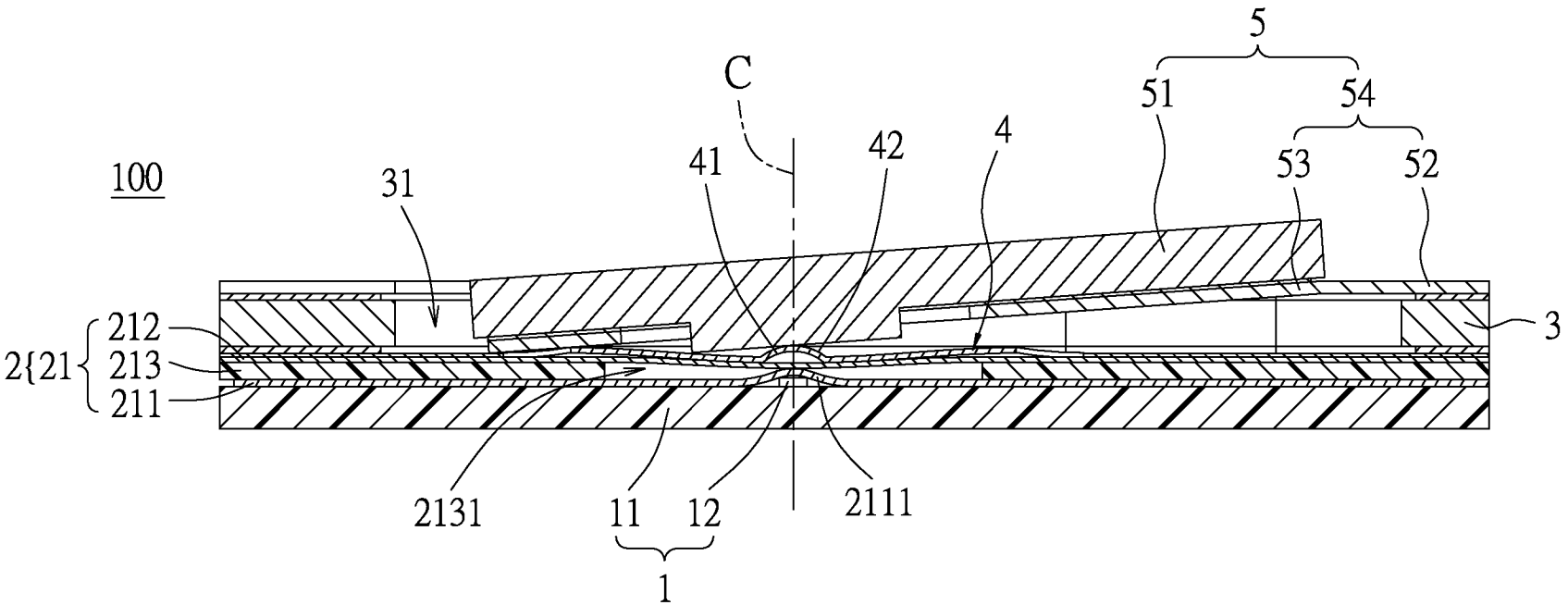
FIG. 9 is a cross-sectional view showing the second embodiment at a conductive position according to the instant disclosure.

Please refer to FIGS. 7 through 9, which show a second embodiment of the instant disclosure. The instant embodiment is similar to the first embodiment, and the identical features are not state again. The difference between the instant embodiment and the first embodiment is the frame 3 and the pressable module 5. The frame 3 of the instant embodiment does not have the pivoting portion 32, and the pressable module 5 of the instant embodiment is stated as follows.

The pressable module 5 has a key body 51 and a positioning sheet 54. The positioning sheet 54 has an assembling portion 52 and a connecting portion 53 formed thereon. Specifically, the positioning sheet 54 in the instant embodiment has at least one U-shaped opening. A portion of the positioning sheet 54 surrounded by the U-shaped opening is defined as the connecting portion 53, and the other portion of the positioning sheet 54 is defined as the assembling portion 52. A segment of the assembling portion 52 adjacent to the connecting portion 53 defines a pivot axis R. A surface of the connecting portion 53 couples with (e.g., adheres to) the key body 51.

The assembling portion 52 of the positioning sheet 54 is fixed on a surface of the frame 3 away from the circuit module 2 (e.g., the top surface of the frame 3 as shown in FIG. 8). The linear portion between the assembling portion 52 and the connecting portion 53 is substantially perpendicular to the central axis C. The key body 51 is arranged above the contact portion 41 of the metal dome 4 and abuts the guiding portion 42, so that the key body 51 is configured to be pressed to rotate along the pivot axis R. Specifically, the key body 51 is configured to be pressed to rotate along the pivot axis R, thusly, the metal dome 4 is deformed and the contact portion 41 is displaced from the original position (as shown in FIG. 8) to the conductive position (as shown in FIG. 9) along the central axis C. When the contact portion 41 is at the original position, the assembling portion 52 and the connecting portion 53 are in a substantially coplanar arrangement.

Figure 10:
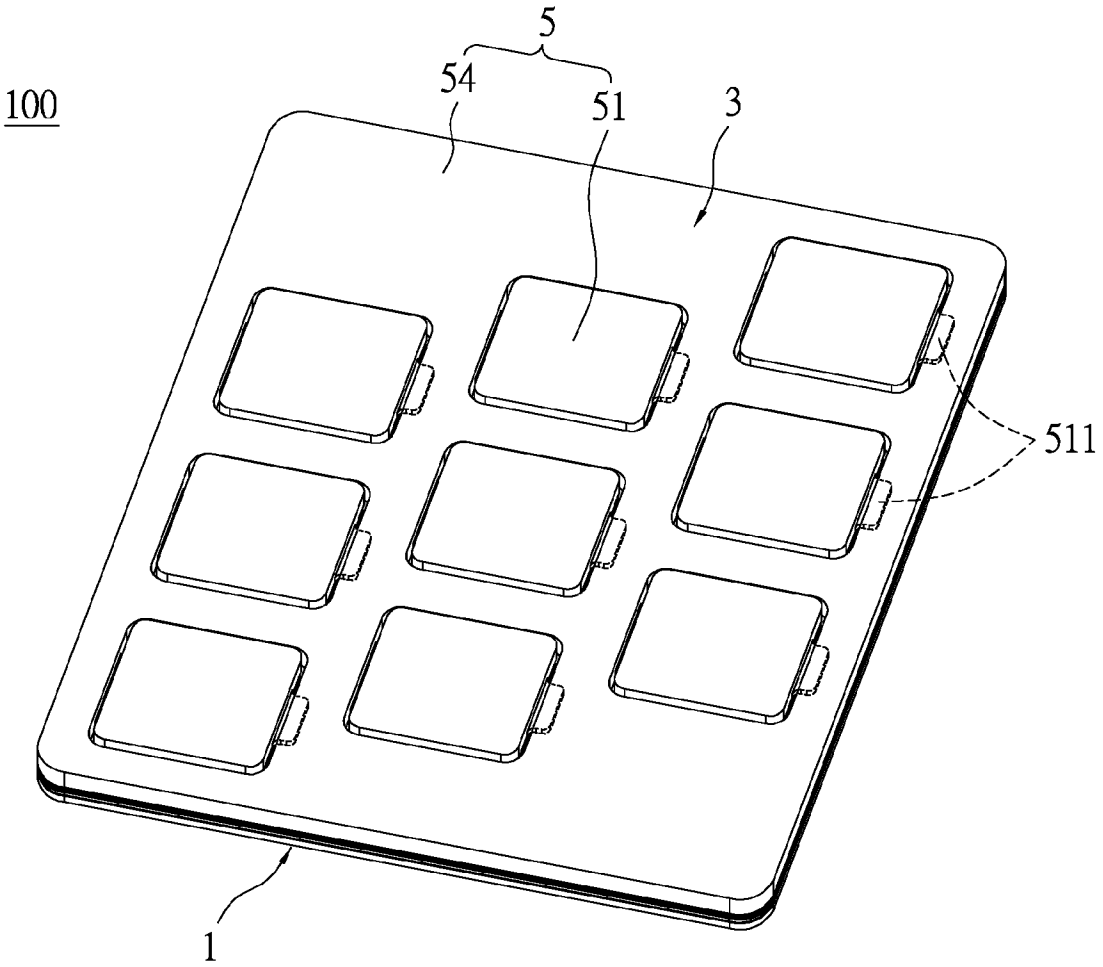
FIG. 10 is a perspective view showing another state of the second embodiment according to the instant disclosure.
Figure 11:
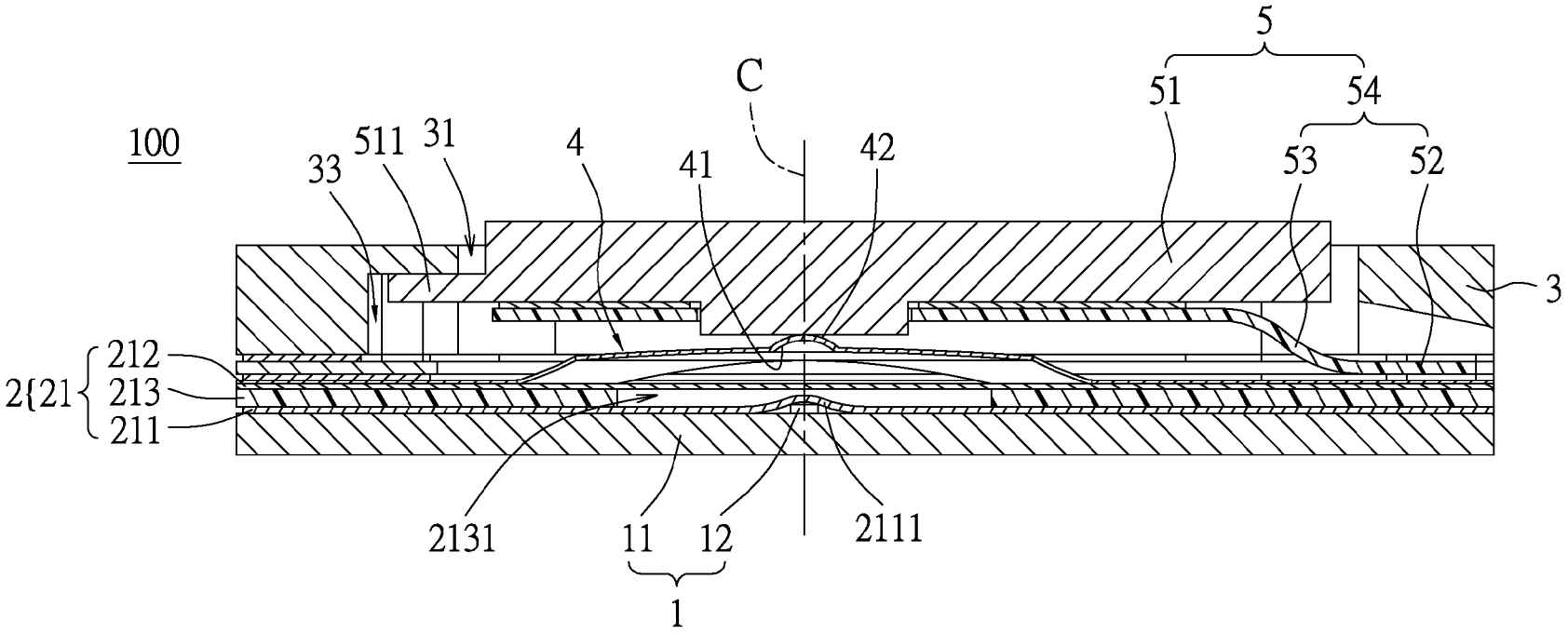
FIG. 11 is a cross-sectional view showing another state of the second embodiment at an original position according to the instant disclosure.
Figure 12:
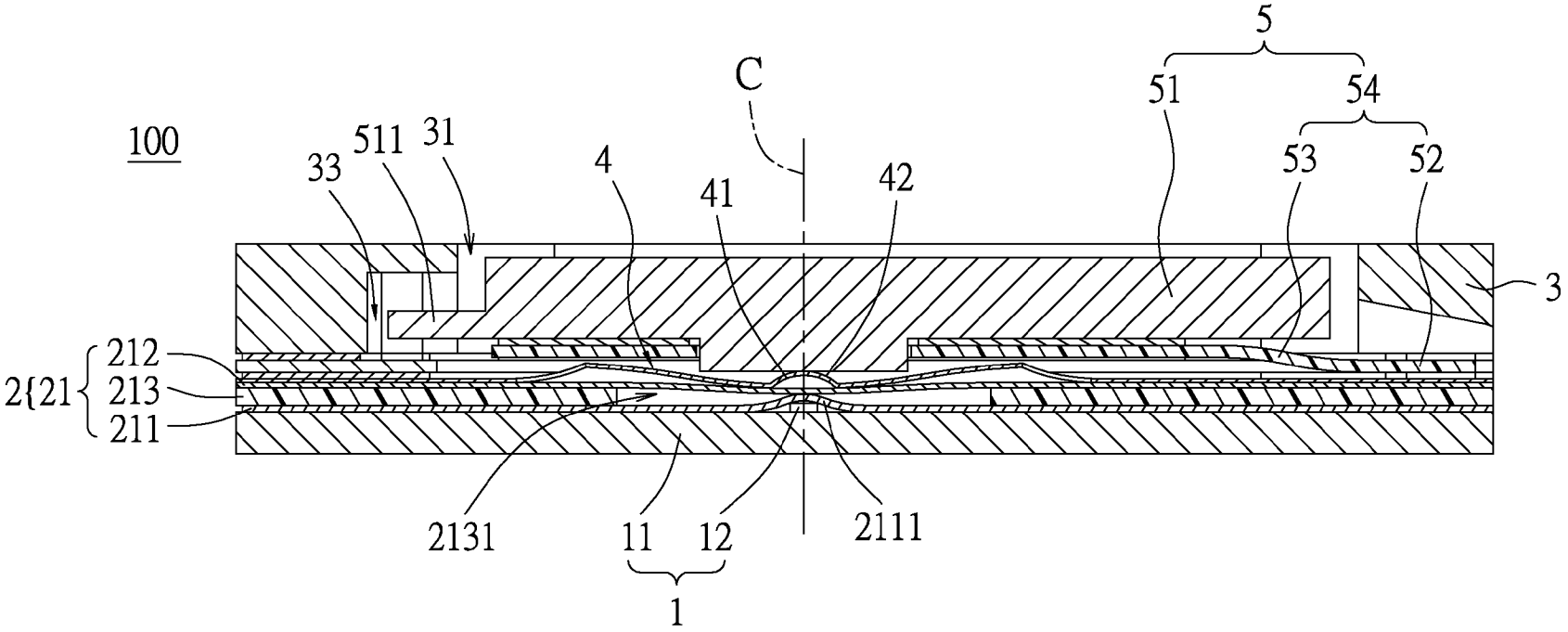
FIG. 12 is a cross-sectional view showing another state of the second embodiment at a conductive position according to the instant disclosure.

Moreover, the assembling portion 52 can be disposed on the frame 3 as shown in FIGS. 10 through 12. The assembling portion 52 of the positioning sheet 54 is fixed on an end surface of the frame 3 adjacent to the circuit module 2 (e.g., the bottom surface of the frame 3 as shown in FIG. 11). The frame 3 has an accommodating trough 33 formed on an inner lateral wall of the frame 3 away from the pivot axis R. The key body 51 has a stopping flange 511 integrally extended from a side edge of the key body 51 away from the pivot axis R. The stopping flange 511 is arranged in the accommodating trough 33 of the frame 3. Thus, when the key body 51 rotates along the pivot axis R, the stopping flange 511 is restricted by the accommodating trough 33 of the frame 3 in order to prevent the key body 51 from over-tilting. When the contact portion 41 is at the conductive position, the assembling portion 52 and the connecting portion 53 are in a substantially coplanar arrangement.

The positioning sheet 54 in the instant embodiment takes the form as shown in FIG. 7 as an example, that is to say, the positioning sheet 54 is a relatively stiff material and is preferably formed by polycarbonate (PC), polyethylene terephthalate (PET), or the other similar material. The contour and the material of the positioning sheet 54 are not limited to the instant embodiment.

Figure 13:
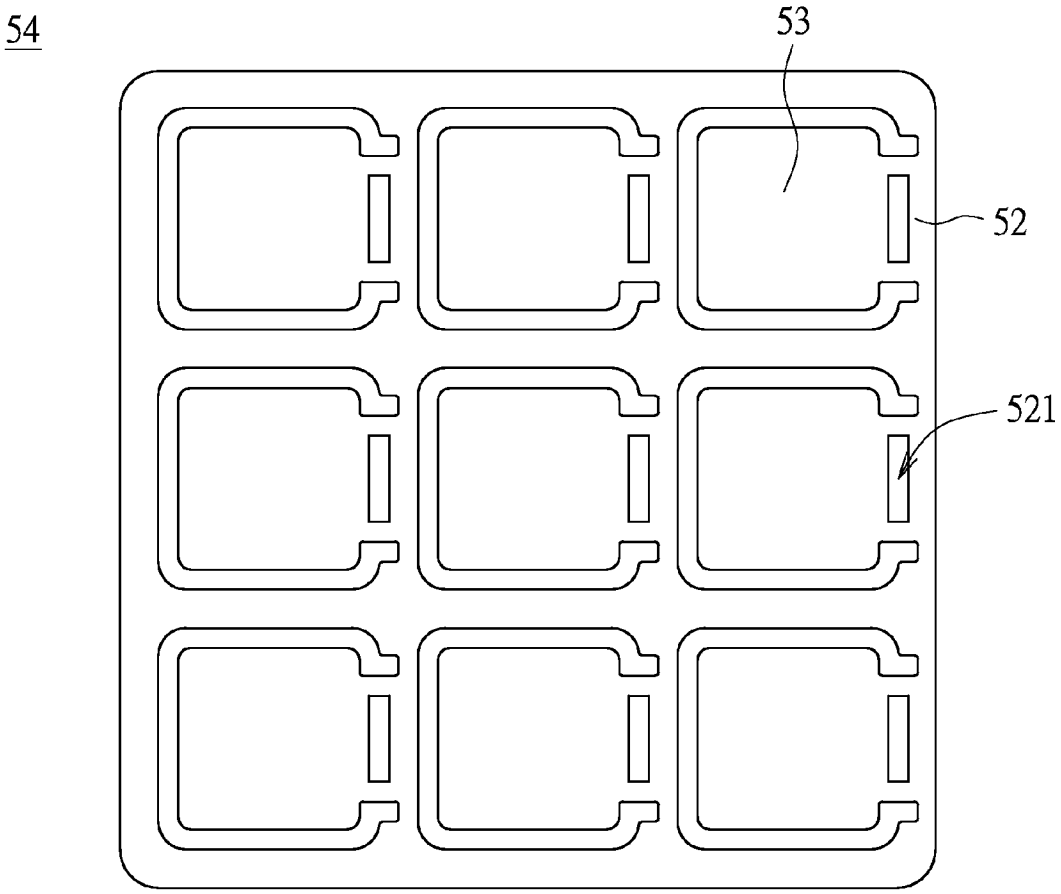
FIG. 13 is a perspective view showing the positioning sheet of another state of the second embodiment according to the instant disclosure.

For example, the positioning sheet 54 can be designed into a form such as FIG. 13 has shown. In more detail, a portion of the assembling portion 52 adjacent to the connecting portion 53 is extended in order to have a longer moment arm when using the positioning sheet 54. Moreover, the portion of the assembling portion 52 adjacent to the connecting portion 53 forms a thru hole 521 to reduce the cross-section thereof.

Figure 14:
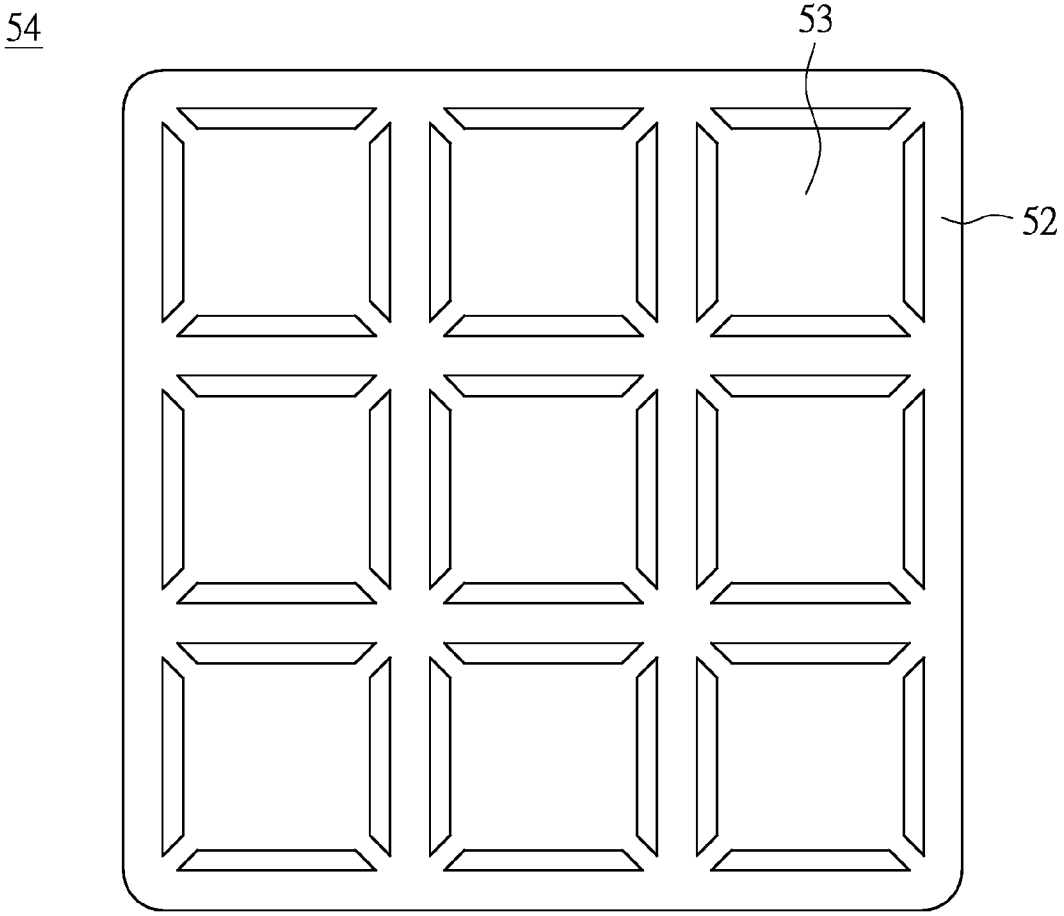
FIG. 14 is a perspective view showing the positioning sheet of still another state of the second embodiment according to the instant disclosure.

Moreover, the positioning sheet 54 can be formed by a soft material as shown in FIG. 14. For example, the positioning sheet 54 can be formed by thermoplastic polyurethane (TPU), rubber, or the other similar material, but not limited thereto. Thus, only an end of the connecting portion 53 connecting to the assembling portion 52 is not sufficient. That is to say, if the connecting portion 53 is formed by forming an opening, at least three connection segments formed between the connecting portion 53 and the assembling portion 52 is necessary. For example, the number of the connecting segment arranged between the connecting portion 53 and the assembling portion 52 as shown in FIG. 14 is four, but not limited thereto.

Additionally, in another embodiment not shown in the figures, the connecting portion 53 and the assembling portion 52 can be integrally formed without any opening.

Third Embodiment

Figure 15:
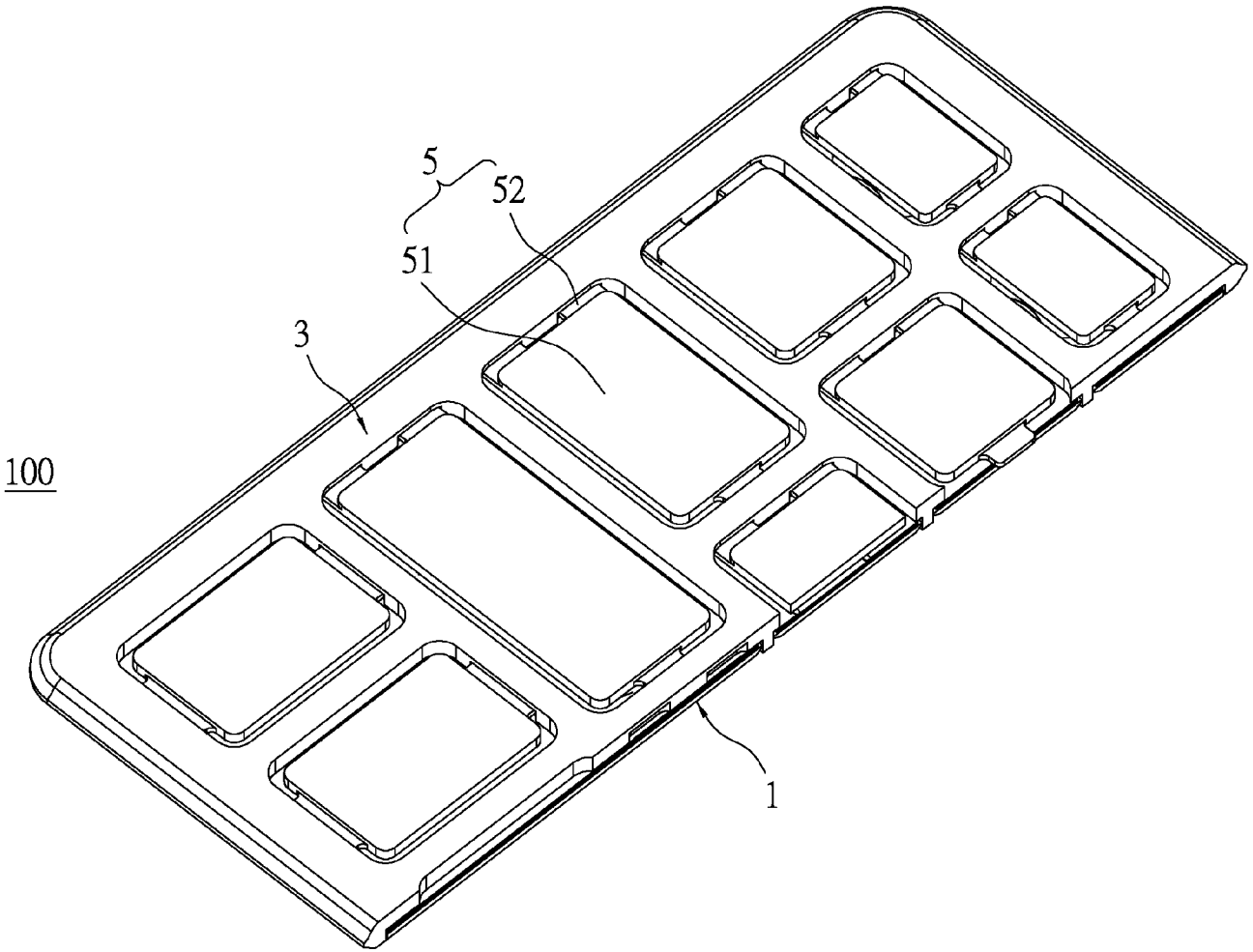
FIG. 15 is a perspective view showing a third embodiment according to the instant disclosure.
Figure 16:
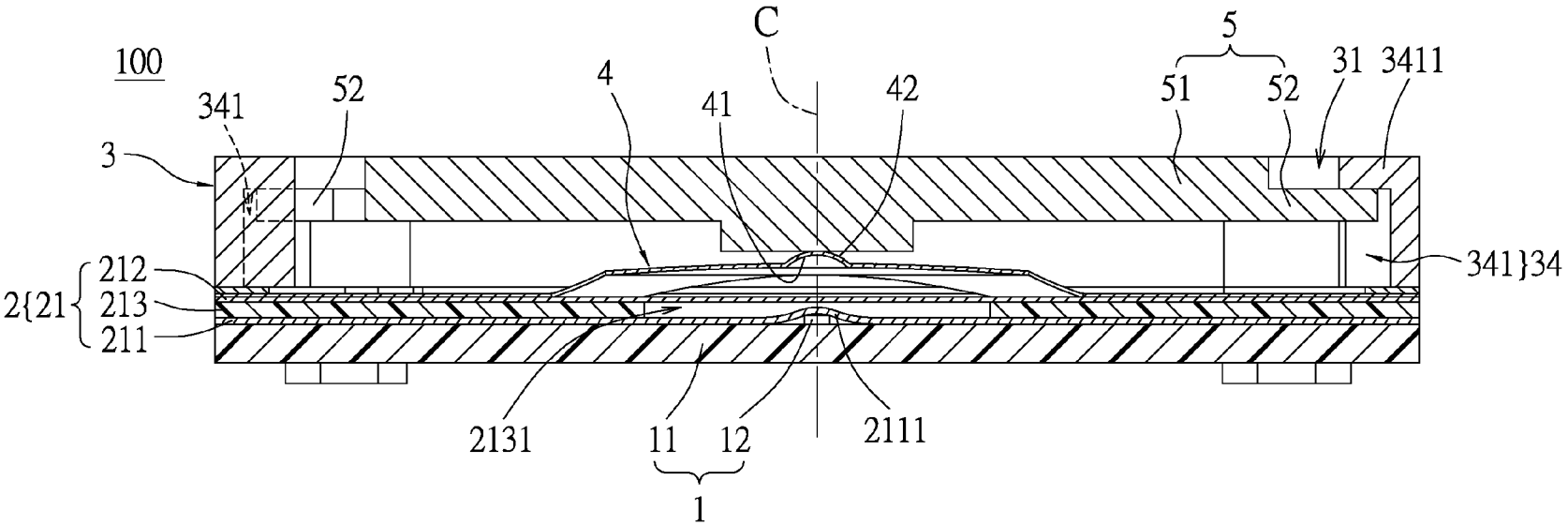
FIG. 16 is a cross-sectional view showing the third embodiment at an original position according to the instant disclosure.
Figure 17:
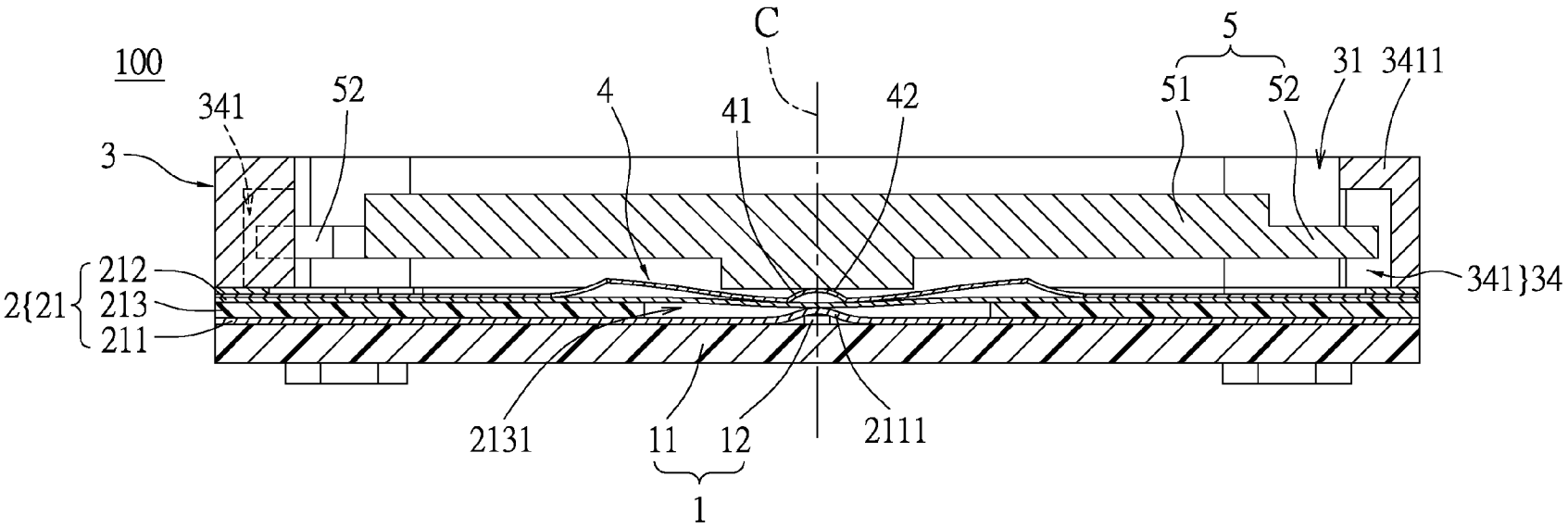
FIG. 17 is a cross-sectional view showing the third embodiment at a conductive position according to the instant disclosure.

Please refer to FIGS. 15 through 17, which show a third embodiment of the instant disclosure. The instant embodiment is similar to the first embodiment, and the identical features are not state again. The difference between the instant embodiment and the first embodiment is the frame 3 and the pressable module 5. The frame 3 of the instant embodiment does not have the pivoting portion 32, but the frame 3 has a track unit 34 formed on an inner side thereof. The pressable module 5 and the track unit 34 of the instant embodiment are stated as follows.

The track unit 34 has a plurality of tracks 341. In more detail, the tracks 341 are formed on two opposite inner lateral walls of the frame 3, and each track 341 defines as a path parallel to the central axis C. Moreover, each track 341 has a stopper 3411 arranged on a portion of each track 341 away from the circuit module 2 to limit the path defined by each track 341, The track 341 is arranged between the circuit module 2 and the corresponding stopper 3411.

The pressable module 5 has a key body 51 and a plurality of assembling portions 52 connected to the key body 51. The assembling portions 52 are respectively and integrally extended from two opposite edges of the key body 51. The number of the assembling portions 52 is identical to the number of the tracks 341, and the shape of the cross-section of each assembling portion 52 conforms to the shape of the cross-section of each track 341.

The key body 51 is arranged above the contact portion 41 of the metal dome 4 and abuts the guiding portion 42 of the metal dome 4. The assembling portions 52 are respectively and movably coupled to the tracks 341 of the frame 3. That is to say, the assembling portions 52 are movable between the circuit module 2 and the corresponding stoppers 3411. Thus, the pressable module 5 is configured to be pressed to move the assembling portions 52 along the tracks 341 such that the metal dome 4 is deformed by the key body 51, and the contact portion 41 is displaced from the original position (as FIG. 16 shown) to the conductive position (as FIG. 17 shown) along the central axis C.

Moreover, the quantity of the assembling portion and the track are more than one, the quantity of the assembling portion and the track can be adjusted by designer's demand and are not be limited to the instant embodiment.

Fourth Embodiment

Figure 18:
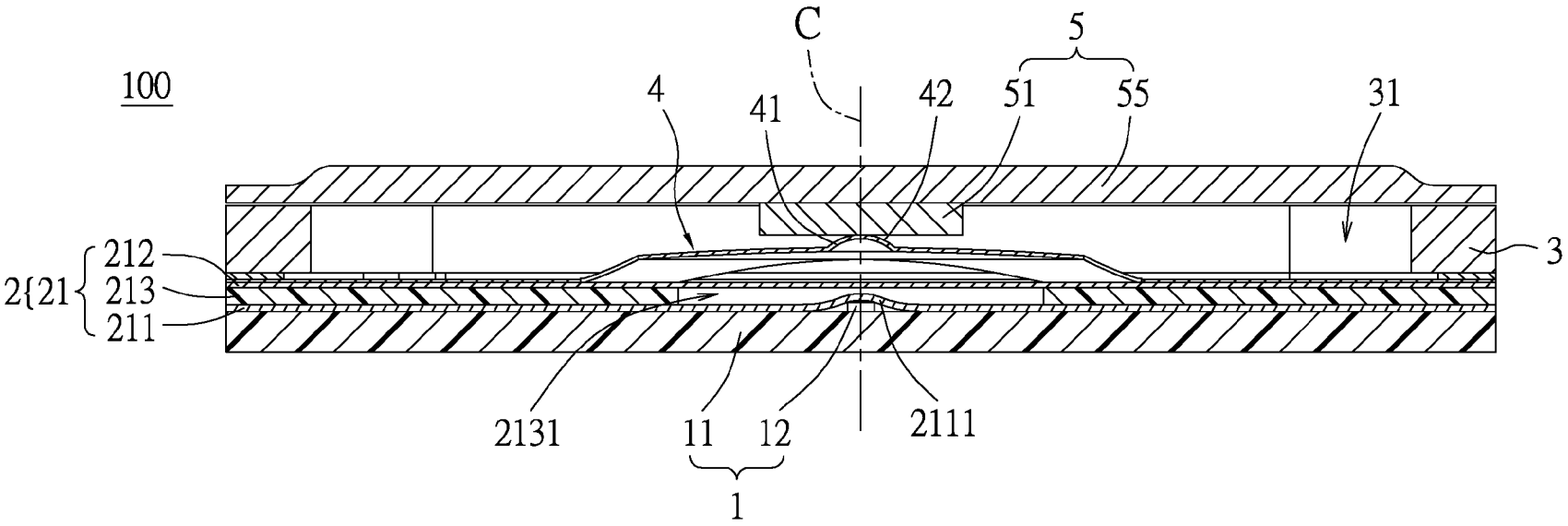
FIG. 18 is a cross-sectional view showing a fourth embodiment at an original position according to the instant disclosure.
Figure 19:
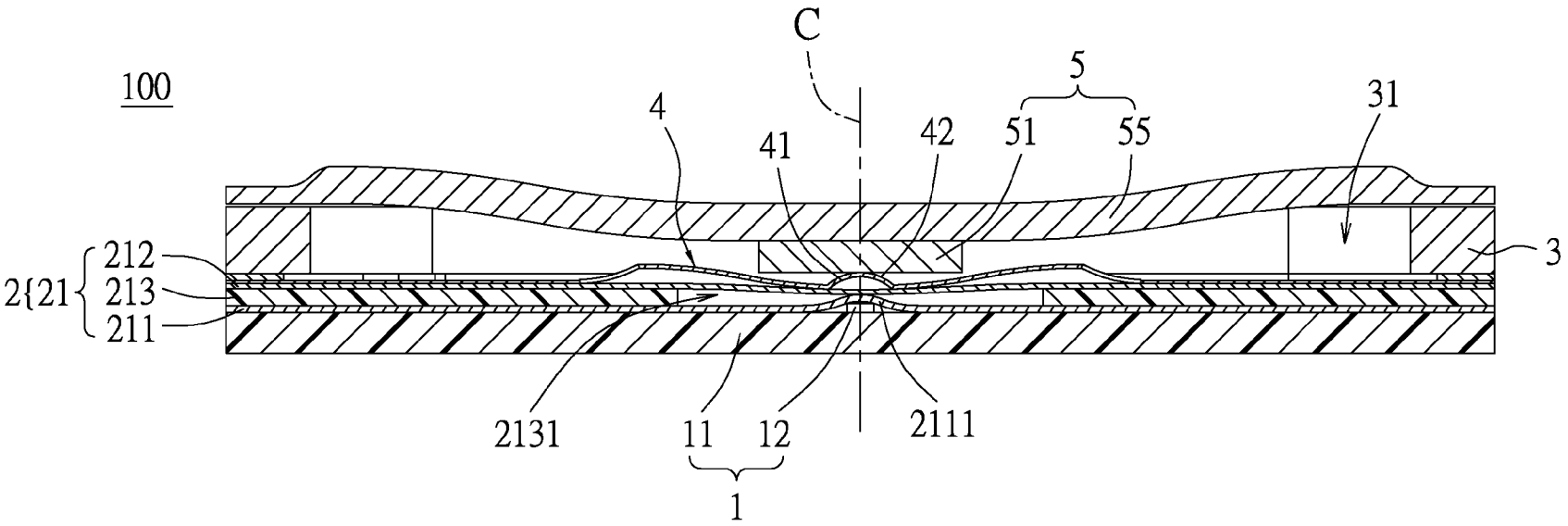
FIG. 19 is a cross-sectional view showing the fourth embodiment at a conductive position according to the instant disclosure.

Please refer to FIGS. 18 and 19, which show a fourth embodiment of the instant disclosure. The instant embodiment is similar to the first embodiment, and the identical features are not state again. The difference between the instant embodiment and the first embodiment is the frame 3 and the pressable module 5. The frame 3 of the instant embodiment does not have the pivoting portion 32, and the pressable module 5 of the instant embodiment is stated as follows.

The pressable module 5 has a covering pad 55 and a key body 51 coupled to (e.g., adhered to) a bottom surface of the covering pad 55. The covering pad 55 is disposed on the frame 3, in other words, the covering pad 55 is fixed on a top surface of the frame 3 as FIG. 18 shown. The key body 51 is arranged above the contact portion 41 of the metal dome 4 and abuts the guiding portion 42 of the metal dome 4. Thus, the covering pad 55 is configured to be pressed to move the key body 51 such that the metal dome 4 is deformed and the contact portion 41 is displaced from the original position (as FIG. 18 shown) to the conductive position (as FIG. 19 shown) along the central axis C.

Fifth Embodiment

Figure 20:
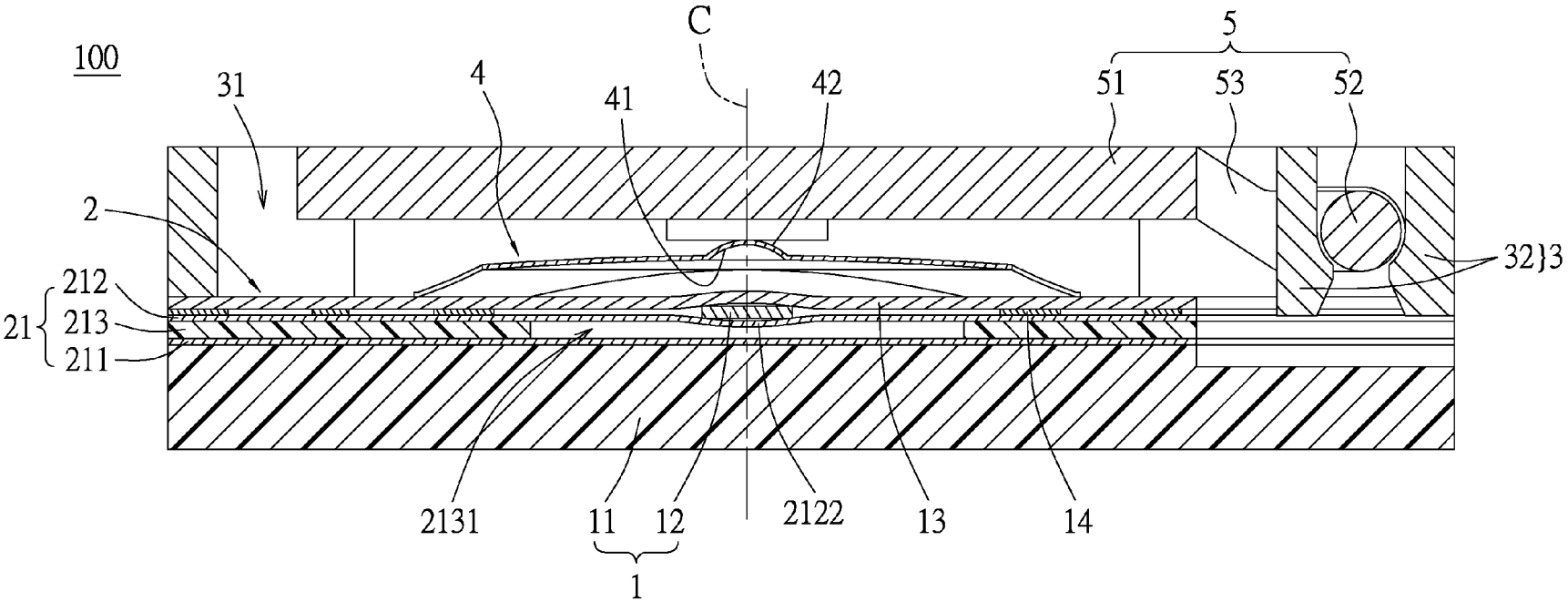
FIG. 20 is a cross-sectional view showing a fifth embodiment at an original position according to the instant disclosure.
Figure 21:
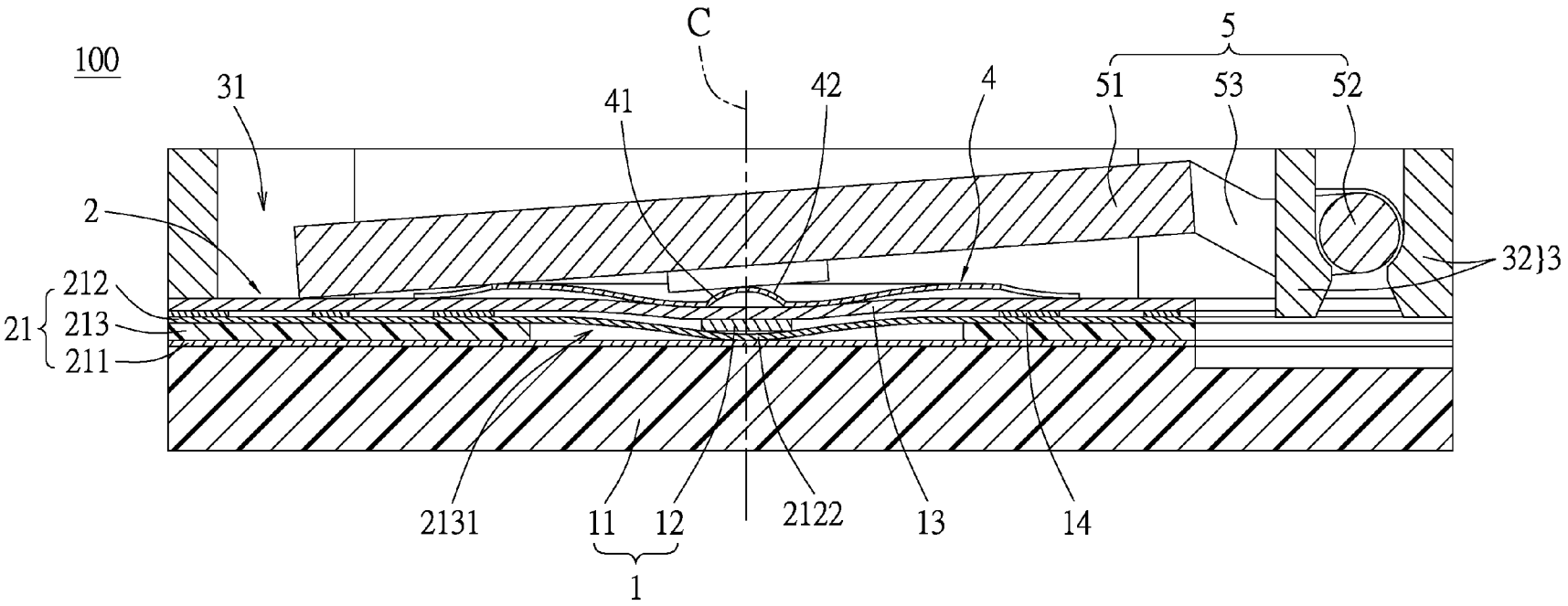
FIG. 21 is a cross-sectional view showing the fifth embodiment at a conductive position according to the instant disclosure.

Please refer to FIGS. 20 and 21, which show a fifth embodiment of the instant disclosure. The instant embodiment is similar to the above embodiments, and the identical features are not state again. The pressable module 5 in the instant embodiment takes the pressable module 5 of the first embodiment for example, the pressable module 5 in the instant embodiment can be replaced by the pressable module 5 disclosed in one of the second, the third, and the fourth embodiments. The difference between the instant embodiment and the above embodiments is the arrangement of the protrusion 12. The supporting module 1 in the instant embodiment further has a supporting sheet 13 and a plurality of supporting blocks 14. The instant embodiment is stated as follows.

The supporting sheet 13 is disposed above the second conductive layer 212, and the metal dome 4 is disposed on the supporting sheet 13. The protrusion 12 arranged on the central axis C is disposed between the supporting sheet 13 and the second conductive layer 212. The supporting blocks 14 are disposed between the supporting sheet 13 and the second conductive layer 212 and are correspondingly arranged to the separating layer 213. The thickness of the protrusion 12 is larger than the thickness of each supporting block 14, and the width of the protrusion 12 is less than the diameter of the accommodating hole 2131, so that a segment of the second conductive layer 212 abutting the protrusion 12 is projected downwardly and defined as the protruding segment 2122. The protruding segment is configured in the accommodating hole 2131. Moreover, a segment of the supporting sheet 13 abutting the protrusion 12 is projected upwardly. Thus, the shortest distance between the first and the second conductive layers 211, 212 is reduced effectively to improve the sensitivity of the membrane 21 by disposing the protrusion 12 and forming the protruding segment 2122. Moreover, the operating distance of the metal dome 4 is reduced by the protruding segment 2122 and the segment of the supporting sheet 13 projected upward.

When the contact portion 41 is at the original position, the protruding segment 2122 of the second conductive layer 212 and a portion of the first conductive layer 211 corresponding to the protruding segment 2122 are configured with a gap therebetween. When the contact portion 41 is at the conductive position, the second conductive layer 212 is pressed by the periphery edge of the contact portion 41, and the protruding segment 2122 is deformed such that the first conductive layer 211 abuts the protruding segment 2122.

Moreover, the supporting blocks 14 can be replaced by another structure, for example, a portion of the supporting sheet 13 corresponding to the frame 3, such as the left side and the right side of the supporting sheet 13 shown in FIG. 20, is adhered to the second conductive layer 212 to replace the supporting blocks 14. The supporting sheet 13 can be designed to have a plurality of U-shaped openings, such as the structure of the positioning sheet 54 shown in FIG. 13, and the portion surrounded by each U-shaped opening is configured to support the metal dome 4 for reducing loads from pressing. Thus, when the metal dome 4 is deformed and abuts the supporting sheet 13, the abutted portion of the supporting sheet 13 are more sensitive to deformation, so that the thin key structure 100 has a relatively preferable pressing feel.

Elements of each embodiment of the instant disclosure are subject to change based on designers' need to provide the thin key structure 100 with different forms for different users. For example, the thin key structure 100 of the instant embodiment takes the adhesion of the supporting sheet 13 and the second conductive layer 212 to replace the supporting blocks 14, the supporting sheet 13 having the U-shaped openings, and the pressable module 5 of the second embodiment, thereby providing the thin key structure 100 a relatively preferable pressing feel.

Base on the above, the thin key structure of the instant disclosure keeps the contact position of the metal dome with respect to the key body via the arrangement of the guiding portion which enables the contact portion to move along the central axis. Moreover, the protrusion is arranged to maintain contact between the contact portion and the circuit module, and the protrusion is arranged to effectively reduce the shortest distance between the first and the second conductive layers such that sensitivity of the membrane is improved. Moreover, the protrusion is arranged to reduce the operating distance of the metal dome for reducing the height of the metal dome.

Additionally, the elements of each embodiment of the instant disclosure can be chosen based on designers' need to provide the thin key structure with different forms for different users.

The descriptions illustrated supra set forth simply the preferred embodiments of the instant disclosure; however, the characteristics of the instant disclosure are by no means restricted thereto. All changes, alternations, or modifications conveniently considered by those skilled in the art are deemed to be encompassed within the scope of the instant disclosure delineated by the following claims.

What is claimed is:

1. A thin key structure, comprising:

a supporting module having a supporting plate and a protrusion, the supporting plate having a plane defined therein and a central axis perpendicular to the plane, and the protrusion is arranged on the central axis;

a circuit module disposed on the supporting plate abutting the protrusion, and the circuit module having a protruding segment formed thereon abutting the protrusion;

a frame disposed on the circuit module and defined with an accommodating space;

a metal dome disposed on the circuit module and in the accommodating space, and an inner portion of the metal dome defined with a contact portion substantially aligning with the central axis;

a pressable module disposed on the frame and at least a portion of the pressable module is configured above the metal dome; and a guiding portion configured to align with the central axis and between the contact portion of the metal dome and the pressable module; the guiding portion is formed on the metal dome or the pressable module, wherein the pressable module is configured to be pressed for deforming the metal dome by the guiding portion to displace the contact portion from an original position to a conductive position along the central axis, when the contact portion is at the original position, the contact portion and the circuit module are configured with a gap therebetween and when the contact portion is at the conductive position, the contact portion presses the circuit module.

2. The thin key structure as claimed in claim 1, wherein the pressable module has a key body, an assembling portion, and a connecting portion connected to the key body and the assembling portion, the assembling portion is disposed on the frame and defines a pivot axis, the key body is arranged above the contact portion of the metal dome, the key body is configured to be pressed to rotate along the pivot axis and deform the metal dome such that the contact portion selectively displaces between the original position and the conductive position.

3. The thin key structure as claimed in claim 2, wherein the frame has a pivoting portion, the connecting portion and the assembling portion integrally extend from the key body in sequence, the assembling portion has an elongated shape and a longitudinal axis of the assembling portion is defined as the pivot axis, the assembling portion is rotatively coupled to the pivoting portion of the frame; and wherein the key body is configured to be pressed to rotate along the pivot axis.

4. The thin key structure as claimed in claim 2, wherein the pressable module has a positioning sheet including the assembling portion and the connecting portion, a segment of the assembling portion adjacent to the connecting portion defines the pivot axis, and the key body is configured to be pressed to rotate along the pivot axis.

5. The thin key structure as claimed in claim 4, wherein the assembling portion of the positioning sheet is fixed on a surface of the frame away from the circuit module and when the contact portion is at the original position, the assembling portion and the connecting portion are in a substantially coplanar arrangement.

6. The thin key structure as claimed in claim 1, wherein the frame has a track unit formed on an inner side thereof, the pressable module has a key body and an assembling portion connected to the key body, the key body is arranged above the contact portion of the metal dome and abuts the metal dome, the assembling portion is movably installed on the track unit of the frame, and the pressable module is configured to be pressed to move the assembling portion along the track unit and deform the metal dome such that the contact portion selectively displaces from the original position to the conductive position along the central axis.

7. The thin key structure as claimed in claim 1, wherein the pressable module has a covering pad and a key body connected to a bottom surface of the covering pad, the covering pad is disposed on the frame and the key body is arranged above the contact portion of the metal dome, and the covering pad is configured to be pressed to move the key body and deform the metal dome such that the contact portion displaces from the original position to the conductive position along the central axis.

8. The thin key structure as claimed in claim 1, wherein the protrusion is disposed on the supporting plate, the circuit module includes a membrane having a first conductive layer, a second conductive layer, and a separating layer disposed between the first and the second conductive layers, the separating layer defines an accommodating hole, the first conductive layer is disposed on the supporting plate, and a segment of the first conductive layer abutting the protrusion is defined as the protruding segment, the protruding segment is configured in the accommodating hole, the metal dome is disposed on the second conductive layer, when the contact portion is at the original position, the protruding segment of the first conductive layer and a portion of the second conductive layer corresponding to the protruding segment are configured with a gap therebetween, and when the contact portion is at the conductive position, the second conductive layer is pressed by the contact portion to deform and abut the protruding segment of the first conductive layer.

9. The thin key structure as claimed in claim 1, wherein the circuit module includes a membrane having a first conductive layer, a second conductive layer, and a separating layer disposed between the first and the second conductive layers, the separating layer defines an accommodating hole, the first conductive layer is disposed on the supporting plate, the supporting module has a supporting sheet disposed above the second conductive layer, the protrusion is disposed between the supporting sheet and the second conductive layer, a segment of the second conductive layer abuts the protrusion is defined as the protruding segment, the protruding segment is configured in the accommodating hole, the metal dome is disposed on the supporting sheet, when the contact portion is at the original position, the protruding segment of the second conductive layer and a portion of the first conductive layer corresponding to the protruding segment are configured with a gap therebetween, and when the contact portion is at the conductive position, the second conductive layer is pressed by the contact portion such that the protruding segment abuts the first conductive layer.

10. The thin key structure as claimed in claim 1, wherein the protrusion is disposed on the supporting plate, the circuit module includes a membrane having a first conductive layer and a second conductive layer disposed on the first conductive layer, the second conductive defines an accommodating opening, the first conductive layer is disposed on the supporting plate, a segment of the first conductive layer abutting the protrusion is defined as the protruding segment, the protruding segment is configured in the accommodating opening, the metal dome is disposed on the second conductive layer, when the contact portion is at the original position, the protruding segment of the first conductive layer and the contact portion are configured with a gap therebetween via the accommodating opening, and when the contact portion is at the conductive position, the contact portion abuts the protruding segment of the first conductive layer.

* * * * *